US011556069B2

(12) United States Patent
Yamauchi

(10) Patent No.: US 11,556,069 B2
(45) Date of Patent: Jan. 17, 2023

(54) TONER

(71) Applicant: KYOCERA Document Solutions Inc., Osaka (JP)

(72) Inventor: Kohei Yamauchi, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 149 days.

(21) Appl. No.: 17/077,167

(22) Filed: Oct. 22, 2020

(65) Prior Publication Data

US 2021/0124282 A1 Apr. 29, 2021

(30) Foreign Application Priority Data

Oct. 24, 2019 (JP) ..... JP2019-193619

(51) Int. Cl.
*G03G 9/093* (2006.01)

(52) U.S. Cl.
CPC ..... *G03G 9/09321* (2013.01); *G03G 9/09371* (2013.01); *G03G 9/09378* (2013.01)

(58) Field of Classification Search
CPC ..... G03G 9/09321; G03G 9/09371; G03G 9/09378
See application file for complete search history.

(56) References Cited

U.S. PATENT DOCUMENTS

2002/0006569 A1* 1/2002 Akai ..... G03G 9/0825 523/335
2003/0175607 A1* 9/2003 Isoda ..... G03G 9/09783 556/132
2018/0224765 A1* 8/2018 Tanaka ..... G03G 9/08711

FOREIGN PATENT DOCUMENTS

JP 2017-062343 3/2017

* cited by examiner

*Primary Examiner* — Peter L Vajda
*Assistant Examiner* — Boone Alexander Evans
(74) *Attorney, Agent, or Firm* — Lex IP Meister, PLLC

(57) ABSTRACT

Toner includes, as toner particles, first particles and second particles. The first particles each include a first core and a first shell layer covering a surface of the first core. The first core contains a first binder resin and is free from metal stearates. The second particles each include a second core and a second shell layer covering a surface of the second core. The second core contains a metal stearate. The first shell layer and the second shell layer are formed of resins of the same type, respectively. The content of the metal stearate in the second core is 50% by mass or more with respect to the mass of the second core as a whole. The number ratio of the second particles is 5% or more but 25% or less of the total number of the first particles and the second particles.

6 Claims, 1 Drawing Sheet

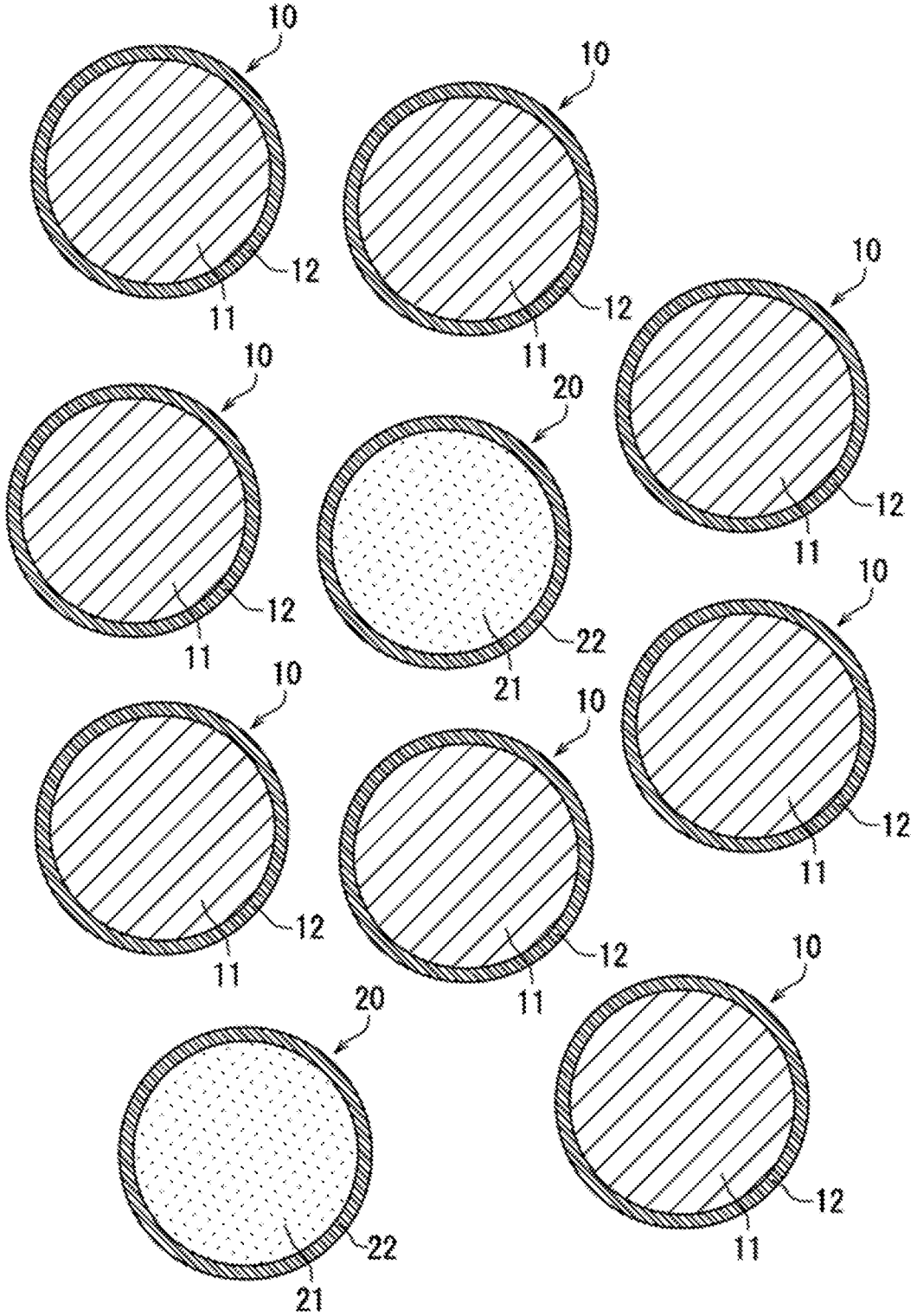
10
12
11
10
12
11
10
12
11
10
12
11
20
22
21
10
12
11
10
12
11
10
12
11
20
22
21
10
12
11

TONER

INCORPORATION BY REFERENCE

This application is based on and claims the benefit of priority from Japanese Patent Application No. 2019-193619 filed on Oct. 24, 2019, which is incorporated herein by reference in its entirety.

BACKGROUND

The present disclosure relates to toner.

In an electrophotographic method, first, the surface of an electrophotographic photoreceptor (hereinafter also referred to as "photoreceptor") serving as an image carrier is charged. Thereafter, the surface of the photoreceptor is exposed to light to form an electrostatic latent image on the photoreceptor. Next, the electrostatic latent image is developed as a toner image with toner, and the toner image is transferred to a recording medium. Then, the toner image on the recording medium is fixed to the recording medium by a fixing device, and an image is formed on the recording medium.

When an image forming process by an electrophotographic method is performed, an ionic substance (for example, a discharge product generated when the photoreceptor is charged) may adhere to the surface of the photoreceptor. In that case, when an image is formed in a high humidity environment, the latent image charge on the photoreceptor is disturbed due to the decrease in electrical resistance of the surface of the photoreceptor caused by the ionic substance. As a result, image deletion (more specifically, a phenomenon in which an image is blurred as if the image were rubbed) may occur.

In order to suppress the occurrence of image deletion, it has been proposed, for instance, to use toner that includes toner particles and metal stearate particles. To the metal stearate particles, the ionic substance on the surface of the photoreceptor is likely to adhere. This is presumably because the affinity between the ester structure in the metal stearate particles and the ionic substance is high. On the other hand, owing to the lubricating ability of the metal stearate, the facility of removal of the metal stearate particles from the surface of the photoreceptor is high. Therefore, the metal stearate particles, to which the ionic substance has been adhered, are quickly removed from the surface of the photoreceptor by a cleaning member (e.g., a cleaning blade) of the image forming apparatus. Thus, according to the proposed technique, the ionic substance on the surface of the photoreceptor can be removed together with the metal stearate particles, so that generation of the image deletion is suppressed.

SUMMARY

Toner according to the present disclosure includes, as toner particles, first particles and second particles. The first particles each include a first core and a first shell layer covering a surface of the first core. The first core contains a first binder resin and is free from metal stearates. The second particles each include a second core and a second shell layer covering a surface of the second core. The second core contains a metal stearate. The first shell layer and the second shell layer are formed of resins of a same type, respectively. A content of the metal stearate in the second core is 50% by mass or more with respect to mass of the second core as a whole. A number ratio of the second particles is 5% or more but 25% or less of a total number of the first particles and the second particles.

BRIEF DESCRIPTION OF THE DRAWINGS

The attached FIGURE is a diagram illustrating an exemplary cross-sectional structure of part of toner according to an embodiment of the present disclosure.

DETAILED DESCRIPTION

Hereinafter, a preferred embodiment of the present disclosure will be described. First, the terms used in this specification will be explained. The term "toner" refers to a collection (e.g., powder) of toner particles. The term "external additive" refers to a collection (for example, powder) of external additive particles. Unless otherwise defined, the evaluation results (values indicating the shape, physical properties, and the like) of the powder (more specifically, the powder of toner particles, the powder of external additive particles, and the like) are each the number average of values obtained by measuring an adequate number of particles selected from the powder.

A measurement value of the volume median diameter (Do) of particles (more specifically, powder of particles) is, unless otherwise defined, a volume-based median diameter measured using a laser diffraction/scattering type particle size distribution measuring device ("LA-950" manufactured by HORIBA, Ltd.).

Unless otherwise defined, the chargeability is the easiness of triboelectric charging. For example, a standard carrier (a standard carrier for toner with a negative charging polarity: N-01, a standard carrier for toner with a positive charging polarity: P-01) provided by the Imaging Society of Japan and a measurement target (e.g., toner) are mixed together and stirred to charge the measurement target by friction. Before and after the triboelectric charging, the charge amount of the measurement target is measured by, for example, a compact suction type charge amount measuring device ("MODEL 2121-S" manufactured by Trek Corporation). A larger change in charge amount before and after the triboelectric charging indicates that the measurement target is more chargeable.

Unless otherwise defined, a measurement value of the softening point (Tm) is a value measured using a capillary rheometer ("CFT-500D" manufactured by Shimadzu Corporation). On an S-shaped curve (horizontal axis: temperature, vertical axis: stroke) plotted by the capillary rheometer, the temperature, at which "(baseline stroke value+maximum stroke value)/2" is obtained, corresponds to the Tm (softening point). Unless otherwise defined, a measurement value of the melting point (Mp) is the temperature, at which the maximum endothermic peak appears in an endothermic curve (vertical axis: heat flow (DSC signal), horizontal axis: temperature) plotted using a differential scanning calorimeter ("DSC 6220" manufactured by Seiko Instruments Inc.). This endothermic peak appears due to melting of the crystallization site. Unless otherwise defined, a measurement value of the glass transition point (Tg) is a value measured using a differential scanning calorimeter ("DSC 6220" manufactured by Seiko Instruments Inc.) in accordance with Japanese Industrial Standards (JIS) K7121-2012. In an endothermic curve (vertical axis: heat flow (DSC signal), horizontal axis: temperature) plotted by the differential scanning calorimeter, the temperature at the inflection point due to glass transition (specifically, the temperature at the intersection of the extrapolated line of the baseline and the extrapolated line of the falling line) corresponds to the Tg (glass transition point).

Unless otherwise defined, a measurement value of the acid value is a value measured according to the neutralization titration method specified in JIS K0070-1992.

The statement that "an organic group (more specifically, an alkyl group or the like) may be substituted with a phenyl group" means that part or the whole of the hydrogen atoms of the organic group may be substituted with a phenyl group.

"An alkyl group having 1 to 6 carbon atoms" is an unsubstituted straight chain or branched chain alkyl group. Examples of the alkyl group having 1 to 6 carbon atoms include a methyl group, an ethyl group, an n-propyl group, an isopropyl group, an n-butyl group, an s-butyl group, a t-butyl group, an n-pentyl group, an isopentyl group, a neopentyl group, and an n-hexyl group.

In the following description, the term "-based" may be appended to the name of a chemical compound to form a generic name encompassing both the chemical compound itself and derivatives thereof. When the name of a chemical compound with the term "-based" appended is used in the name of a polymer, it is indicated that a repeating unit of the polymer originates from the chemical compound or a derivative thereof. The term "(meth)acryl" is used herein as a generic term for both acryl and methacryl. Also, the term "(meth)acrylonitrile" is used herein as a generic term for both acrylonitrile and methacrylonitrile.

<Toner>

The toner according to the present embodiment can be suitably used for developing an electrostatic latent image, for example, as a positively chargeable toner. The positively chargeable toner is positively charged by friction with a carrier, a developing sleeve, or a blade in a developing device.

The toner according to the present embodiment is a collection (for example, powder) of toner particles (specifically, first particles and second particles described later). The toner may be used as a one component developer. Alternatively, a two component developer may be prepared by mixing the toner and a carrier using a mixing device (for example, a ball mill).

The first particles included in the toner according to the present embodiment each include a first core and a first shell layer covering a surface of the first core. The first core contains a first binder resin and does not contain any metal stearates. The second particles included in the toner according to the present embodiment each include a second core and a second shell layer covering a surface of the second core. The second core contains a metal stearate. The first shell layer and the second shell layer are formed of resins of the same type, respectively. The content of the metal stearate in the second core is 50% by mass or more with respect to the mass of the second core as a whole. The number ratio of the second particles is 5% or more but 25% or less of the total number of the first particles and the second particles.

When it is stated that two or more resins are of the same type, it is meant that monomers constituting the resins, respectively, are identical in type. However, when it is determined whether or not two or more resins are of the same type, the composition ratio of monomers constituting a resin is not considered. For example, a resin in which the composition ratio of monomers is "styrene r butyl acrylate=50/50 (mass ratio)" and a resin in which the composition ratio of monomers is "styrene/butyl acrylate=30/70 (mass ratio)" are of the same type because the monomers constituting the resins, respectively, are identical in type.

Hereinafter, the content (unit: % by mass) of the metal stearate in the second core with respect to the mass of the second core as a whole is also referred to as "metal stearate content". In addition, the ratio (unit: %) of the number of the second particles to the total number of the first particles and the second particles is also referred to as "second particle number ratio". The method of measuring the second particle number ratio is the same as or equivalent to the method in Examples described later.

The toner according to the present embodiment can suppress the occurrence of image deletion and the occurrence of fogging by providing the above-described configuration. The reason is presumed as follows.

The toner according to the present embodiment includes the second particles containing a metal stearate at a content of 50% by mass or more. In the toner according to the present embodiment, the second particle number ratio is 5% or more. Therefore, when the toner according to the present embodiment is used for image formation, the second shell layer is destroyed in the toner fixing process, and the metal stearate in the second core is supplied to the surface of the photoreceptor. An ionic substance on the surface of the photoreceptor adheres to the metal stearate supplied to the surface of the photoreceptor. Further, the metal stearate, to which the ionic substance is adhered, is rapidly removed from the surface of the photoreceptor by a cleaning member of the image forming apparatus. Therefore, according to the toner of the present embodiment, the ionic substance on the surface of the photoreceptor can be effectively removed together with the metal stearate. Therefore, the toner according to the present embodiment can suppress the occurrence of image deletion.

In the toner according to the present embodiment, both the first particles and the second particles are toner particles (capsule toner particles) each having a shell layer, and the shell layer of each first particle (first shell layer) and the shell layer of each second particle (second shell layer) are formed of resins of the same type, respectively. The number ratio of the second particles containing the metal stearate (second particle number ratio) is 25% or less. Therefore, the toner according to the present embodiment has a relatively sharp charge amount distribution in the developing device, so that the occurrence of fogging is suppressed.

The first particles may include an external additive. When the first particles include an external additive, the first particles include toner mother particles each having the first core and the first shell layer (hereinafter also referred to as "first toner mother particles"), and the external additive. The external additive adheres to a surface of each first toner mother particle. If not necessary, the external additive may be omitted. In the case where the external additive is omitted, the first toner mother particles correspond to the first particles.

The second particles may include an external additive. When the second particles include an external additive, the second particles include toner mother particles each having the second core and the second shell layer (hereinafter also referred to as "second toner mother particles"), and the external additive. The external additive adheres to a surface of each second toner mother particle. If not necessary, the external additive may be omitted. In the case where the external additive is omitted, the second toner mother particles correspond to the second particles.

The first core may contain an internal additive (for example, at least one of a colorant, a release agent, a charge control agent, and a magnetic powder), if necessary, in addition to the first binder resin.

In addition to the metal stearate, the second core may contain one or more selected from the group consisting of a second binder resin and internal additives other than the metal stearate (including at least one of a colorant, a release agent, a charge control agent, and a magnetic powder).

In the present embodiment, in order to further suppress the occurrence of image deletion and the occurrence of fogging, the metal stearate content is preferably 55% by mass or more but 97% by mass or less.

In the present embodiment, the amount of the second particles is preferably 5 parts by mass or more but 33 parts by mass or less per 100 parts by mass of the first particles in order to further suppress the occurrence of image deletion and the occurrence of fogging.

In the present embodiment, in order to obtain toner suitable for image formation, the thickness of the first shell layer is preferably 5 nm or more but 30 nm or less, more preferably 10 nm or more but 30 nm or less. The method for measuring the thickness of the first shell layer is the same as or equivalent to the method in Examples described later.

In the present embodiment, in order to further suppress the occurrence of image deletion and the occurrence of fogging, the thickness of the second shell layer is preferably 3 nm or more but 30 nm or less, more preferably 10 nm or more but 30 nm or less, and still more preferably 10 nm or more but 15 nm or less. The method for measuring the thickness of the second shell layer is the same as or equivalent to the method in Examples described later.

Hereinafter, details of the toner according to the present embodiment will be described with appropriate reference to the FIGURE. It should be noted that the FIGURE chiefly illustrates respective components in a schematic manner in order to facilitate understanding. The illustrated components may differ in size, number, shape, and the like from actual components for convenience of illustration.

[Configuration of Toner Particles]

Hereinafter, the configuration of the toner particles (more specifically, the first particles and the second particles) included in the toner according to the present embodiment will be described with reference to the FIGURE. The FIGURE is a diagram illustrating an exemplary cross-sectional structure of part of the toner according to the present embodiment. For ease of description, both first particles 10 and second particles 20 illustrated in the FIGURE are toner particles that do not include an external additive.

The first particles 10 shown in the FIGURE each include a first core 11 and a first shell layer 12 covering a surface of the first core 11. The first core 11 contains the first binder resin and does not contain any metal stearates.

In order to obtain toner suitable for image formation, the volume median diameter (Do) of the first core 11 is preferably 4 μm or more but 9 μm or less.

In order to obtain toner suitable for image formation, the area ratio of a surface region of the first core 11 that is covered by the first shell layer 12 (hereinafter also referred to as "first shell coverage") is preferably 90% or more, with an area ratio of 100% being particularly preferred.

The second particles 20 shown in the FIGURE each include a second core 21 and a second shell layer 22 covering a surface of the second core 21. The second core 21 contains a metal stearate.

In order to obtain toner suitable for image formation, the volume median diameter ($D_{50}$) of the second core 21 is preferably 4 μm or more but 9 μm or less.

In order to further suppress the occurrence of fogging, the area ratio of a surface region of the second core 21 that is covered by the second shell layer 22 (hereinafter also referred to as "second shell coverage") is preferably 90% or more, with an area ratio of 100% being particularly preferred.

The first shell layer 12 and the second shell layer 22 are formed of resins of the same type, respectively. The content of the metal stearate in the second core 21 is 50% by mass or more with respect to the mass of the second core 21 as a whole. The number ratio of the second particles 20 is 5% or more but 25% or less of the total number of the first particles 10 and the second particles 20.

An example of the toner particles included in the toner according to the present embodiment has been described above with reference to the FIGURE, but the present disclosure is not limited to such exemplary toner particles. The toner particles included in the toner according to the present disclosure may include an external additive (not shown). For example, the first particles 10 shown in the FIGURE may be replaced by first toner mother particles that have an external additive adhered to the surfaces of the first toner mother particles and are, as such, used as the first particles included in the toner according to the present disclosure. In addition, the second particles 20 illustrated in the FIGURE may be replaced by second toner mother particles that have an external additive adhered to the surfaces of the second toner mother particles and are, as such, used as the second particles included in the toner according to the present disclosure.

[Elements of Toner Particles]

Next, elements of the toner particles included in the toner according to the present embodiment will be described.

{First Particles}Hereinafter, ingredients contained in the first particles will be described.

(First Binder Resin)

In the first core, the first binder resin accounts for 80% by mass or more of all ingredients, for example. Therefore, it is considered that the properties of the first binder resin greatly affect the properties of the entire first core. By using a plurality of resins in combination as the first binder resin, the properties (more specifically, the Tg and the like) of the first binder resin can be adjusted.

In order to obtain toner having an excellent low-temperature fixability, the first core preferably contains a thermoplastic resin as the first binder resin, and more preferably contains the thermoplastic resin at a ratio of 85% by mass or more of the entire first binder resin. Examples of the thermoplastic resin include styrene-based resins, acrylic ester-based resins, olefin-based resins (more specifically, polyethylene resins, polypropylene resins, and the like), vinyl resins (more specifically, vinyl chloride resins, polyvinyl alcohol, vinyl ether resins, N-vinyl resins, and the like), polyester resins, polyamide resins, and urethane resins. In addition, copolymers of such resins, that is, a copolymer in which an arbitrary repeating unit is introduced into any of such resins (more specifically, a styrene-acrylic ester-based resin, a styrene-butadiene-based resin or the like) can be used as the first binder resin.

The thermoplastic resin is obtained by addition polymerization, copolymerization or condensation polymerization of one or more thermoplastic monomers. The thermoplastic monomer is a monomer that becomes a thermoplastic resin by homopolymerization (more specifically, an acrylic ester-based monomer, a styrene-based monomer or the like) or a monomer that becomes a thermoplastic resin by condensation polymerization (for example, a combination of a polyhydric alcohol and a polyvalent carboxylic acid that becomes a polyester resin by condensation polymerization).

In order to obtain toner having an excellent low-temperature fixability, the first core preferably contains a polyester resin as the first binder resin, and more preferably contains the polyester resin at a ratio of 80% by mass or more but 100% by mass or less of the entire first binder resin. In order to enhance the reactivity with an oxazoline group in a repeating unit (1-1) described later, the polyester resin contained as the first binder resin preferably has an acid value of 10 mg KOH/g or more but 30 mg KOH/g or less.

The polyester resin is obtained by condensation polymerization of one or more polyhydric alcohols and one or more polycarboxylic acids. Examples of polyhydric alcohols used for synthesis of a polyester resin include dihydric alcohols (more specifically, aliphatic diols, bisphenols, and the like) and trihydric or higher alcohols listed below. Examples of polycarboxylic acids used for synthesis of a polyester resin include dibasic carboxylic acids and tribasic or higher carboxylic acids listed below. Note that a polycarboxylic acid derivative (more specifically, an anhydride of a polycarboxylic acid, a polycarboxylic acid halide or the like) that can form an ester bond through condensation polymerization may be used instead of a polycarboxylic acid.

Suitable examples of the aliphatic diols include diethylene glycol, triethylene glycol, neopentyl glycol, 1,2-propanediol, α,ω-alkanediol (more specifically, ethylene glycol, 1,3-propanediol, 1,4-butanediol, 1,5-pentanediol, 1,6-hexanediol, 1,7-heptanediol, 1,8-octanediol, 1,9-nonanediol, 1,12-dodecanediol or the like), 2-butene-1,4-diol, 1,4-cyclohexanedimethanol, dipropylene glycol, polyethylene glycol, polypropylene glycol, and polytetramethylene glycol.

Suitable examples of the bisphenols include bisphenol A, hydrogenated bisphenol A, bisphenol A ethylene oxide adduct, and bisphenol A propylene oxide adduct.

Suitable examples of the trihydric or higher alcohols include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Suitable examples of the dibasic carboxylic acids include maleic acid, fumaric acid, citraconic acid, itaconic acid, glutaconic acid, phthalic acid, isophthalic acid, terephthalic acid, cyclohexanedicarboxylic acid, adipic acid, sebacic acid, azelaic acid, malonic acid, 1,10-decanedicarboxylic acid, succinic acid, alkylsuccinic acid (more specifically, n-butylsuccinic acid, isobutylsuccinic acid, n-octylsuccinic acid, n-dodecylsuccinic acid, isododecylsuccinic acid or the like), and alkenylsuccinic acid (more specifically, n-butenylsuccinic acid, isobutenylsuccinic acid, n-octenylsuccinic acid, n-dodecenylsuccinic acid, isododecenylsuccinic acid or the like).

Suitable examples of the tribasic or higher carboxylic acids include 1,2,4-benzenetricarboxylic acid (trimellitic acid), 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra (methylenecarboxyl) methane, 1,2,7,8-octanetetracarboxylic acid, pyromellitic acid, and Empol trimer acid.

When a polyester resin is used as the first binder resin, the polyester resin may be an amorphous polyester resin or a crystalline polyester resin. In order to obtain toner having an excellent low-temperature fixability while easily securing a wide fixing temperature range, the first core preferably contains the amorphous polyester resin and the crystalline polyester resin as the first binder resin. When the first core contains the amorphous polyester resin and the crystalline polyester resin, the mixing ratio of the amorphous polyester resin and the crystalline polyester resin is not particularly limited and, for example, 1 part by mass or more but 30 parts by mass or less of the crystalline polyester resin may be mixed with 100 parts by mass of the amorphous polyester resin. The amorphous polyester resin refers to a polyester resin in which any clear endothermic peaks are not observed in an endothermic curve plotted using a differential scanning calorimeter.

(Colorant)

The first core may contain a colorant. As the colorant, a known pigment or dye can be used in accordance with the color of the toner. In order to form a high-quality image using the toner, the amount of the colorant in the first core is preferably 1 part by mass or more but 20 parts by mass or less per 100 parts by mass of the first binder resin.

The first core may contain a black colorant. Examples of the black colorant include carbon black. The black colorant may be a colorant that is adjusted to black color using a yellow colorant, a magenta colorant, and a cyan colorant.

The first core may contain a chromatic colorant. Examples of the chromatic colorant include a yellow colorant, a magenta colorant, and a cyan colorant.

As the yellow colorant, for example, one or more compounds selected from the group consisting of condensed azo compounds, isoindolinone compounds, anthraquinone compounds, azo metal complexes, methine compounds, and arylamide compounds can be used. Examples of the yellow colorant include C.I. Pigment Yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, and 194), naphthol yellow S. Hansa yellow G. and C.I. Vat Yellow.

As the magenta colorant, for example, one or more compounds selected from the group consisting of condensed azo compounds, diketopyrrolopyrrole compounds, anthraquinone compounds, quinacridone compounds, basic dye lake compounds, naphthol compounds, benzimidazolone compounds, thioindigo compounds, and perylene compounds can be used. Examples of the magenta colorant include C.I. Pigment Red (2, 3, 5, 6, 7, 19, 23, 48:2, 48:3, 48:4, 57:1, 81:1, 122, 144, 146, 150, 166, 169, 177, 184, 185, 202, 206, 220, 221, and 254).

As the cyan colorant, for example, one or more compounds selected from the group consisting of copper phthalocyanine compounds, anthraquinone compounds, and basic dye lake compounds can be used. Examples of the cyan colorant include C.I. Pigment Blue (1, 7, 15, 15:1, 15:2, 15:3, 15:4, 60, 62, and 66), phthalocyanine blue, C.I. Vat Blue. and C.I. Acid Blue.

(Release Agent)

The first core may contain a release agent. The release agent is used to obtain toner having an excellent offset resistance, for example. In order to obtain toner having an excellent offset resistance, the amount of the release agent in the first core is preferably 1 part by mass or more but 20 parts by mass or less per 100 parts by mass of the first binder resin.

Examples of the release agent include ester wax, polyolefin wax (more specifically, polyethylene wax, polypropylene wax or the like), microcrystalline wax, fluororesin wax, Fischer-Tropsch wax, paraffin wax, candelilla wax, montan wax, and castor wax. Examples of the ester wax include natural ester waxes (more specifically, carnauba wax, rice wax, and the like) and synthetic ester waxes. In the present embodiment, one release agent may be used alone or a plurality of release agents may be used in combination.

In order to improve the compatibility between the first binder resin and the release agent, a compatibilizer may be added to the first core.

(Charge Control Agent)

The first core may contain a charge control agent. The charge control agent is used to obtain toner that is excellent in charge stability or charge rise characteristics, for example. The charge rise characteristics of toner serve as an index of whether or not the toner can be charged to a predetermined charge level in a short period of time.

By adding a positively chargeable charge control agent to the first core, the cationic property (positive chargeability) of the first core can be enhanced. In addition, by adding a negatively chargeable charge control agent to the first core, the anionic property (negative chargeability) of the first core can be enhanced.

Examples of the positively chargeable charge control agent include: azine compounds such as pyridazine, pyrimidine, pyrazine, 1,2-oxazine, 1,3-oxazine, 1,4-oxazine, 1,2-thiazine, 1,3-thiazine, 1,4-thiazine, 1,2,3-triazine, 1,2,4-triazine, 1,3,5-triazine, 1,2,4-oxadiazine, 1,3,4-oxadiazine, 1,2,6-oxadiazine, 1,3,4-thiadiazine, 1,3,5-thiadiazine, 1,2,3,4-tetrazine, 1,2,4,5-tetrazine, 1,2,3,5-tetrazine, 1,2,4,6-oxatriazine, 1,3,4,5-oxatriazine, phthalazine, quinazoline, and quinoxaline; direct dyes such as Azine Fast Red FC, Azine Fast Red 12BK, Azine Violet BO, Azine Brown 3G, Azine Light Brown GR, Azine Dark Green BH/C, Azine Deep Black EW, and Azine Deep Black 3RL; acid dyes such as Nigrosine BK, Nigrosine NB, and Nigrosine Z; alkoxylated amine; alkylamide; quaternary ammonium salts such as benzyldecylhexylmethyl ammonium chloride, decyltrimethyl ammonium chloride, 2-(methacryloyloxy)ethyl trimethylammonium chloride, and dimethylaminopropyl acrylamide methyl chloride quaternary salt; and a resin having a quaternary ammonium cation group. The charge control agents listed above may be used alone or in combination of two or more charge control agents.

Examples of the negatively chargeable charge control agent include an organometallic complex which is a chelate compound. The organometallic complex is preferably one or more selected from the group consisting of an acetylacetone metal complex, a salicylic acid-based metal complex, and salts of these complexes.

In order to obtain toner having an excellent charge stability, the amount of the charge control agent in the first core is preferably 0.1 parts by mass or more but 20 parts by mass or less per 100 parts by mass of the first binder resin.

(Magnetic Powder)

The first core may contain a magnetic powder. Examples of the material for the magnetic powder include a ferromagnetic metal (more specifically, iron, cobalt, nickel or the like) and an alloy thereof, a ferromagnetic metal oxide (more specifically, ferrite, magnetite, chromium dioxide or the like), and a material subjected to a ferromagnetization treatment (more specifically, a carbon material, to which ferromagnetism is imparted by a heat treatment, or the like). In the present embodiment, one magnetic powder may be used alone or a plurality of magnetic powders may be used in combination.

(First Shell Layer)

Next, the first shell layer will be described. The first shell layer is not particularly limited as long as the first shell layer is formed of a resin that is of the same type as the constituent resin of the second shell layer described below. As the constituent resin of the first shell layer, for example, one or more resins selected from the group consisting of known thermosetting resins and known thermoplastic resins can be used.

When a thermosetting resin is used as the constituent resin of the first shell layer, examples of usable thermosetting resins include a melamine resin, a urea resin, a glyoxal resin, and a guanamine resin.

When a thermoplastic resin is used as the constituent resin of the first shell layer, examples of usable thermoplastic resins include styrene-based resins, acrylic ester-based resins, olefin-based resins (more specifically, polyethylene resins, polypropylene resins, and the like), vinyl resins (more specifically, vinyl chloride resins, polyvinyl alcohol, vinyl ether resins. N-vinyl resins, and the like), polyester resins, polyamide resins, and urethane resins. In addition, copolymers of such resins, that is, a copolymer in which an arbitrary repeating unit is introduced into any of such resins (more specifically, a styrene-acrylic acid-based resin, a styrene-butadiene-based resin or the like) can be used as the constituent resin of the first shell layer.

In the case where the first core contains a polyester resin as the first binder resin, in order to increase the first shell coverage, the first shell layer is preferably composed of a polymerization product (resin) of a monomer including at least a compound represented by the following formula (1) (hereinafter also referred to as "compound (1)").

[Chemical Formula 1]

(1)

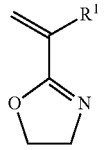

In the formula (1), $R^1$ represents an alkyl group that has 1 to 6 carbon atoms and may be substituted with a phenyl group or represents a hydrogen atom. Suitable examples of $R^1$ include a hydrogen atom, a methyl group, an ethyl group, and an isopropyl group. In order to increase the first shell coverage, $R^1$ is preferably a hydrogen atom.

The polymerization product of a monomer including at least the compound (1) may be a polymerization product obtained by copolymerizing the compound (1) with another vinyl compound. A vinyl compound refers to a compound having a vinyl group ($CH_2$=CH—) or a hydrogen-substituted vinyl group (more specifically, ethylene, propylene, butadiene, vinyl chloride, (meth)acrylic acid, methyl (meth) acrylate, (meth)acrylonitrile, styrene or the like). The vinyl compound can be subjected to addition polymerization based on a carbon-carbon double bond (C=C) contained in the vinyl group or the like to form a polymer (resin).

In order to further increase the first shell coverage, one or more vinyl compounds selected from the group consisting of alkyl (meth)acrylates (more specifically, alkyl acrylates and alkyl methacrylates) and styrene-based monomers (more specifically, styrene) are preferable as another vinyl compound.

When an alkyl (meth)acrylate is used as another vinyl compound, in order to easily form the first shell layer, the alkyl (meth)acrylate is preferably one or more selected from the group consisting of methyl (meth)acrylate, ethyl (meth) acrylate, n-propyl (meth)acrylate, isopropyl (meth)acrylate, butyl (meth)acrylate (more specifically, n-butyl (meth)acrylate, isobutyl (meth)acrylate or the like), and 2-ethylhexyl (meth)acrylate.

The compound (1) forms a repeating unit represented by the following formula (1-1) (hereinafter also referred to as "repeating unit (1-1)") by addition polymerization. $R^1$ in the following formula (1-1) has the same meaning as $R^1$ in the formula (1).

[Chemical Formula 2]

(1-1)

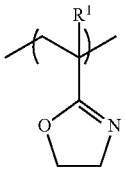

The repeating unit (1-1) has a ring-unopened oxazoline group. The ring-unopened oxazoline group has a cyclic structure and exhibits a strong positive chargeability. The ring-unopened oxazoline group easily reacts with a carboxy group, an aromatic sulfanyl group, and an aromatic hydroxy group. For example, when the repeating unit (1-1) reacts with a carboxy group of the polyester resin in the first core during the formation of the first shell layer, the ring of the oxazoline group is opened and an amide bond and an ester bond are formed as shown in the following formula (1-2). Formation of such bonds results in a strong attachment of the first core and the first shell layer to each other, and detachment of the first shell layer from the first core is suppressed. $R^1$ in the following formula (1-2) has the same meaning as $R^1$ in the formula (1). The symbol "*" in the following formula (1-2) represents a site to be bonded to an atom in the first core.

[Chemical Formula 3]

(1-2)

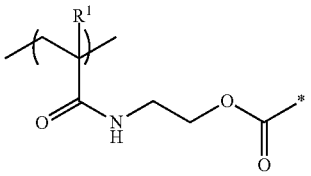

In the case where the toner according to the present embodiment is a positively chargeable toner, in order to suppress the detachment of the first shell layer from the first core while stably maintaining the positive chargeability of the toner, the first shell layer preferably contains a vinyl resin having the repeating unit (1-1) and a repeating unit represented by the formula (1-2) (hereinafter also referred to as "repeating unit (1-2)"). Hereinafter, the resin, which contains at least the repeating unit (1-1) and the repeating unit (1-2), is also referred to as "specific vinyl resin". In the case where the toner according to the present embodiment is a positively chargeable toner, in order to further suppress the detachment of the first shell layer from the first core while more stably maintaining the positive chargeability of the toner, it is preferable that the first shell layer is formed of the specific vinyl resin (that is to say, the resin constituting the first shell layer is only the specific vinyl resin).

As the ratio (molar ratio) of the repeating unit (1-1) in the specific vinyl resin increases, the positive chargeability of the specific vinyl resin (and hence the positive chargeability of the toner) tends to increase. On the other hand, as the ratio (molar ratio) of the repeating unit (1-2) in the specific vinyl resin increases, the attachment of the first core and the first shell layer to each other tends to be stronger. The molar ratio between the repeating unit (1-1) and the repeating unit (1-2) in the specific vinyl resin can be adjusted, for example, by changing the acid value of the polyester resin in the first core.

Examples of the method for confirming that the ring of the oxazoline group is opened to form the repeating unit (1-2) during the formation of the first shell layer include the following method. Specifically, a predetermined amount of the first particles (sample) is dissolved in a solvent. The obtained solution is placed in a test tube for nuclear magnetic resonance (NMR) measurement, and the $^1$H NMR spectrum is measured using an NMR apparatus. In the $^1$H NMR spectrum, a triplet signal derived from the secondary amide appears in the vicinity of a chemical shift 6 of 6.5. Therefore, when a triplet signal is confirmed around a chemical shift 6 of 6.5 in the obtained $^1$H NMR spectrum, it is presumed that the ring of the oxazoline group is opened and the repeating unit (1-2) is formed during the formation of the first shell layer. As an example of the measurement conditions of the $^1$H-NMR spectrum, the following conditions are given.

(Example of 1H NMR Spectrum Measurement Conditions)

NMR apparatus: Fourier transform nuclear magnetic resonance (FT-NMR) apparatus ("JNM AL400" manufactured by JEOL Ltd.)

NMR measurement test tube: 5 mm test tube

Solvent: deuterochloroform (1 mL)

Sample temperature: 20° C.

Sample mass: 20 mg

Accumulation frequency: 128 times

Internal standard for chemical shift: tetramethylsilane (TMS)

In order to further increase the first shell coverage, the specific vinyl resin preferably further contains a repeating unit derived from an alkyl (meth)acrylate. In order to even further increase the first shell coverage, the specific vinyl resin preferably only contains, as repeating units, at least one repeating unit derived from an alkyl (meth)acrylate, the repeating unit (1-1), and the repeating unit (1-2).

As a raw material for forming the first shell layer, for example, oxazoline group-containing polymer aqueous solutions ("EPOCROS (registered trademark) VS series" manufactured by Nippon Shokubai Co., Ltd.) are usable. Among such solutions, "EPOCROS WS-300" contains a copolymer of 2-vinyl-2-oxazoline (a kind of compound (1)) and methyl methacrylate (mass ratio of monomers forming the copolymer: methyl methacrylate/2-vinyl-2-oxazoline=1/9). "EPOCROS WS-700" contains a copolymer of 2-vinyl-2-oxazoline, methyl methacrylate, and butyl acrylate (mass ratio of monomers forming the copolymer: methyl methacrylate/2-vinyl-2-oxazoline/butyl acrylate=4/5/1).

(External Additive)

The first particles may further include an external additive. Examples of the method for externally adding the external additive include a method in which the first particles 10 shown in the FIGURE are used as the first toner mother particles, and the first toner mother particles (powder) and the external additive particles (powder) are stirred together to cause the external additive particles to adhere to the surfaces of the first toner mother particles.

As the external additive particles, inorganic particles are preferable, and silica particles and particles of a metal oxide (more specifically, alumina, titanium oxide, magnesium oxide, zinc oxide, strontium titanate, barium titanate or the like) are particularly preferred. In the present embodiment, one type of external additive particles may be used alone or a plurality of types of external additive particles may be used in combination.

The external additive particles may be surface-treated. For example, when silica particles are used as the external additive particles, hydrophobicity and/or positive chargeability may be imparted to the surfaces of the silica particles by a surface treatment agent. Examples of the surface treatment agent include coupling agents (more specifically, silane coupling agents, titanate coupling agents, aluminate coupling agents, and the like), silazane compounds (more specifically, chain silazane compounds, cyclic silazane compounds, and the like), and silicone oils (more specifically, dimethyl silicone oils and the like). One or more selected from the group consisting of silane coupling agents and silazane compounds are particularly preferable as the surface treatment agent. Suitable examples of the silane coupling agents include silane compounds (more specifically, methyltrimethoxysilane, aminosilane, and the like). Suitable examples of the silazane compounds include hexamethyldisilazane (HMDS). When the surface of a silica matrix (untreated silica particles) is treated with the surface treatment agent, a large number of hydroxy groups (—OI) present on the surface of the silica matrix are partially or entirely substituted with a functional group derived from the surface treatment agent. As a result, silica particles having the functional group derived from the surface treatment agent (specifically, a functional group having higher hydrophobicity and/or higher positive chargeability than the hydroxy group) on the surfaces are obtained.

{Second Particles}

Next, ingredients contained in the second particles will be described. Hereinafter, description, whose contents overlap with the contents of the above description on the first particles may be omitted.

(Metal Stearate)

Examples of the metal stearate contained in the second core include zinc stearate, calcium stearate, barium stearate, lead stearate, iron stearate, nickel stearate, cobalt stearate, copper stearate, strontium stearate, cadmium stearate, and magnesium stearate. In order to further suppress the occurrence of image deletion and the occurrence of fogging, the metal stearate contained in the second core is preferably zinc stearate or calcium stearate.

The metal stearate can be contained in the second core, for example, by using metal stearate particles as a material (ingredient) for preparing the second core.

(Second Binder Resin)

The second core may contain a second binder resin. As the second binder resin, for example, the resins mentioned above as an example of the first binder resin can be used. The second binder resin may be of the same type as or different from the first binder resin. Resins preferable as the second binder resin are identical to the resins preferable as the first binder resin described above.

In order to further suppress the occurrence of image deletion and the occurrence of fogging, the amount of the second binder resin is preferably 1 part by mass or more but 100 parts by mass or less and more preferably 2 parts by mass or more but 80 parts by mass or less per 100 parts by mass of the metal stearate.

(Colorant)

The second core may contain a colorant. As the colorant to be contained in the second core, for example, the colorants mentioned above as an example of the colorant contained in the first core can be used. The colorant in the second core may be of the same type as or different from the colorant in the first core. In order to obtain toner suitable for image formation, the amount of the colorant in the second core is preferably 0.1 parts by mass or more but 10.0 parts by mass or less and more preferably 0.2 parts by mass or more but 6.0 parts by mass or less per 100 parts by mass of the metal stearate.

(Release Agent)

The second core may contain a release agent. As the release agent to be contained in the second core, for example, the release agents mentioned above as an example of the release agent contained in the first core can be used. The release agent in the second core may be of the same type as or different from the release agent in the first core. In order to obtain toner excellent in offset resistance, the amount of the release agent in the second core is preferably 0.1 parts by mass or more but 10.0 parts by mass or less and more preferably 0.2 parts by mass or more but 5.0 parts by mass or less per 100 parts by mass of the metal stearate.

(Charge Control Agent)

The second core may contain a charge control agent. As the charge control agent to be contained in the second core, for example, the charge control agents mentioned above as an example of the charge control agent contained in the first core can be used. The charge control agent in the second core may be of the same type as or different from the charge control agent in the first core. In order to obtain toner having an excellent charge stability, the amount of the charge control agent in the second core is preferably 1 part by mass or more but 3 parts by mass or less per 100 parts by mass of the metal stearate.

(Magnetic Powder)

The second core may contain a magnetic powder. As the magnetic powder to be contained in the second core, for example, the magnetic powders mentioned above as an example of the magnetic powder contained in the first core can be used. The magnetic powder in the second core may be of the same type as or different from the magnetic powder in the first core.

(Second Shell Layer)

Next, the second shell layer will be described. The second shell layer is formed of a resin that is of the same type as the constituent resin of the first shell layer.

When the second core further contains a polyester resin as the second binder resin, in order to increase the second shell coverage, the second shell layer is preferably formed of a polymerization product (resin) of monomers including at least the compound (1). When the second shell layer is formed of a polymerization product (resin) of monomers including at least the compound (1), the first shell layer is also formed of a polymerization product (resin) of monomers including at least the compound (1). When the first shell layer is formed of a polymerization product (resin) of monomers including at least the compound (1), the first core preferably contains a polyester resin as the first binder resin in order to increase the first shell coverage. Therefore, in order to increase the first shell coverage and the second shell coverage, it is preferable that the first core contains a polyester resin as the first binder resin, the second core further contains a polyester resin as the second binder resin, and each of the first shell layer and the second shell layer is formed of a polymerization product (resin) of monomers including at least the compound (1).

In the case where the toner according to the present embodiment is a positively chargeable toner, in order to suppress detachment of the second shell layer from the second core while stably maintaining the positive chargeability of the toner, it is preferable that the second shell layer is formed of the specific vinyl resin (that is to say, the resin constituting the second shell layer is only the specific vinyl resin). The molar ratio between the repeating unit (1-1) and the repeating unit (1-2) in the specific vinyl resin can be adjusted, for example, by changing the acid value of the polyester resin in the second core. Regarding the specific vinyl resin constituting the second shell layer, the symbol "*" in the formula (1-2) representing the repeating unit (1-2) represents a site to be bonded to an atom in the second core.

Examples of the method for confirming that the ring of the oxazoline group is opened to form the repeating unit (1-2) during the formation of the second shell layer include the same method as the above-described method for confirming that the ring of the oxazoline group is opened to form the repeating unit (1-2) during the formation of the first shell layer.

(External Additive)

The second particles may further include an external additive. Examples of the method for externally adding the external additive include a method in which the second particles 20 shown in the FIGURE are used as the second toner mother particles, and the second toner mother particles (powder) and the external additive particles (powder) are stirred together to cause the external additive particles to adhere to the surfaces of the second toner mother particles.

As the external additive particles to be included in the second particles, for example, the external additive particles mentioned above as an example of the external additive particles included in the first particles can be used. The external additive particles in the second particles may be of the same type as or different from the external additive particles in the first particles.

In the case where both the first particles and the second particles further include an external additive, in order to sufficiently exhibit the function of the external additive while suppressing separation of the external additive particles from the first toner mother particles and the second toner mother particles, the amount of the external additive (the total amount of a plurality of types of external additive particles if such external additive particles are used) is preferably 0.5 parts by mass or more but 10 parts by mass or less per 100 parts by mass in total of the first toner mother particles and the second toner mother particles.

{Suitable Combination of Materials}

In the case where the toner according to the present embodiment is a positively chargeable toner, in order to further suppress the occurrence of image deletion and the occurrence of fogging while more stably maintaining the positive chargeability of the toner, it is preferable that both of the first shell layer and the second shell layer are formed of the specific vinyl resin.

In addition, in order to obtain toner capable of particularly suppressing the occurrence of image deletion and the occurrence of fogging, the constituent materials for toner preferably satisfy the following condition 1, and more preferably satisfy the following condition 2.

Condition 1: The metal stearate in the second core is zinc stearate or calcium stearate, the first core contains a polyester resin as the first binder resin, the second core further contains a polyester resin as the second binder resin, and both the first shell layer and the second shell layer are formed of the specific vinyl resin.

Condition 2: The condition 1 is satisfied and, moreover, the specific vinyl resin constituting the first shell layer and the second shell layer only contains, as repeating units, at least one repeating unit derived from an alkyl (meth)acrylate, the repeating unit (1-1), and the repeating unit (1-2).

<Method for Producing Toner>

Next, a preferable method for producing the toner according to the above-described embodiment will be described. Hereinafter, description on components overlapping with the components of the toner according to the above-described embodiment will be omitted. Hereinafter, the first core and the second core may be collectively referred to as "core". The first toner mother particles and the second toner mother particles may be collectively referred to as "toner mother particles".

[Toner Mother Particle Preparation Process]

(Core Preparing Process)

First, a core is prepared by an aggregation method or a pulverization method.

The aggregation method includes, for example, an aggregation process and a coalescence process. In the aggregation process, fine particles containing ingredients constituting the core (specifically, either the first core or the second core) are aggregated in an aqueous medium to form aggregated particles. In the coalescence process, the ingredients contained in the aggregated particles are coalesced in an aqueous medium to form the core.

Next, the pulverization method will be described. According to the pulverization method, the core can be prepared relatively easily and the production costs can be reduced. When the core is prepared by the pulverization method, the core preparing process includes, for example, a melt-kneading process and a pulverization process. The core preparing process may further include a mixing process preceding the melt-kneading process. The core preparing process may further include at least one of a fine pulverization process and a classification process, both following the pulverization process.

In the mixing process, for example, ingredients constituting the core (specifically, either the first core or the second core) are mixed to obtain a mixture. In the melt-kneading process, a toner material is melted and kneaded to obtain a melt-kneaded product. As the toner material, for example, the mixture obtained in the mixing process is used. In the pulverization process, the obtained melt-kneaded product is cooled to, for example, room temperature (25° C.) and then pulverized to obtain a pulverized product. When it is necessary to reduce the diameter of the pulverized product obtained in the pulverization process, a process for further pulverizing the pulverized product (fine pulverization process) may be performed. In addition, when the particle size of the pulverized product is to be made uniform, a process for classifying the obtained pulverized product (classification process) may be performed. Through the above-described processes, cores as a pulverized product are obtained.

(Shell Layer Forming Process)

Next, the obtained first and second cores, a raw material (shell raw material) for forming the first and second shell layers, and water (for example, ion-exchanged water) are put into a reaction container. Examples of the shell raw material include an oxazoline group-containing polymer aqueous solution. Next, the internal temperature of the container is raised to a set temperature (for example, a temperature of 50° C. or higher but 70° C. or lower) while stirring the container contents. The temperature raising rate at this time is, for example, 0.4° C./min or more but 0.6° C./min or less.

After the internal temperature of the container reaches the set temperature, the container contents are stirred while maintaining the set temperature for a predetermined time (for example, for 30 minutes or more but 180 minutes or less) to form the first shell layer covering the surface of the first core and the second shell layer covering the surface of the second core, thereby obtaining a dispersion containing toner mother particles. When an oxazoline group-containing polymer aqueous solution is used as the shell raw material, a part of the oxazoline groups of the oxazoline group-containing polymer reacts with, for example, a part of the carboxy groups present on the surfaces of the cores to achieve the ring opening until the internal temperature of the container reaches the set temperature and/or while the set temperature is maintained for a predetermined time. Together with the ring opening of the oxazoline groups, the amide bonds and the ester bonds are formed between the core (specifically, the first core and the second core) and the shell layer (specifically, the first shell layer and the second shell layer) containing the oxazoline group-containing polymer.

The thickness of the first shell layer, the thickness of the second shell layer, the first shell coverage, and the second shell coverage can each be adjusted by changing at least one of the acid value of the binder resin in the core, the solid content concentration of the shell raw material, and the amount of the shell raw material used with respect to the mass of the core, for example.

[Washing Process and Drying Process]

Subsequently, the toner mother particles in the obtained dispersion are washed with ion-exchanged water, and then the toner mother particles are dried using, for example, a continuous surface modifying apparatus. Thus, powder of the toner mother particles is obtained.

[External Addition Process]

Thereafter, if necessary, the obtained toner mother particles and an external additive may be mixed using a mixer (for example, an FM mixer manufactured by Nippon Coke & Engineering Co., Ltd.) to cause the external additive to adhere to the surfaces of the toner mother particles. The toner mother particles (more specifically, the first toner mother particles and the second toner mother particles) may be used as the toner particles (more specifically, the first particles and the second particles) without causing the external additive to adhere to the toner mother particles. Thus, the toner (powder of toner particles) according to the above-described embodiment is obtained.

EXAMPLES

Hereinafter, Examples of the present disclosure will be described. The present disclosure is not limited to the scope of Examples.

<Synthesis of Binder Resin>

Hereinafter, a method for synthesizing an amorphous polyester resin R-1 and a composite resin R-2 that are used as the binder resin (specifically, the first binder resin and the second binder resin) will be described.

[Synthesis of Amorphous Polyester Resin R-1]

A four neck flask having a capacity of 1 L and equipped with a thermometer (thermocouple), a dewatering tube, a nitrogen-introducing tube, and a stirrer was set in a mantle heater. Subsequently, the flask was charged with 100 g of bisphenol A propylene oxide adduct (average addition number of moles of propylene oxide: 2 mol), 100 g of bisphenol A ethylene oxide adduct (average addition number of moles of ethylene oxide: 2 mol), 50 g of terephthalic acid, 30 g of adipic acid, and 54 g of tin (II) 2-ethyl hexanoate. Subsequently, the atmosphere in the flask was changed to a nitrogen atmosphere, and then the flask was heated for two hours until the internal temperature of the flask became 235° C. Subsequently, the flask contents were reacted in a nitrogen atmosphere at a temperature of 235° C. until the reaction rate reached 90% by mass. The reaction rate was calculated according to the formula "reaction rate=100×(actual amount of water generated by reaction)/(theoretical amount of water generated)". Subsequently, the flask contents were reacted in a reduced-pressure atmosphere (pressure: 8 kPa) at a temperature of 235° C. until the Tm of a reaction product (resin) reached a predetermined temperature (90° C.) to obtain the amorphous polyester resin R-1. The amorphous polyester resin R-1 had a Tg of 30° C., a Tm of 90° C., and an acid value of 15 mg KOH/g.

[Synthesis of Composite Resin R-2]

A four neck flask having a capacity of 2 L and equipped with a thermometer (thermocouple), a dewatering tube, a nitrogen-introducing tube, and a stirrer was set in a mantle heater. Subsequently, the flask was charged with 69 g of ethylene glycol, 214 g of sebacic acid, and 54 g of tin (II) 2-ethyl hexanoate. Subsequently, the atmosphere in the flask was changed to a nitrogen atmosphere, and then the flask was heated for two hours until the internal temperature of the flask became 235° C. Subsequently, the flask contents were reacted in a nitrogen atmosphere at a temperature of 235° C. until the reaction rate represented by the above formula reached 95% by mass, and then the flask was cooled until the internal temperature of the flask reached 160° C. Subsequently, a mixed solution of 156 g of styrene, 195 g of butyl methacrylate, and 0.5 g of dibutyl peroxide was added dropwise to the flask through a dropping funnel over one hour. Subsequently, the flask contents were kept in a nitrogen atmosphere at a temperature of 160° C. for 30 minutes. Subsequently, the flask contents were reacted in a reduced pressure atmosphere (pressure: 8 kPa) at a temperature of 200° C. for one hour, and then the flask was cooled until the internal temperature of the flask became 180° C. Subsequently, 1.0 g of 4-t-butylcatechol as a radical polymerization inhibitor was put into the flask, and then the flask was heated in a reduced pressure atmosphere (pressure: 8 kPa) for two hours until the internal temperature of the flask became 210° C. Subsequently, the flask contents were reacted in a reduced-pressure atmosphere (pressure: 40 kPa) at a temperature of 210° C. for one hour to obtain the composite resin R-2, which is a composite resin of a crystalline polyester resin and a styrene-butyl methacrylate copolymer. The composite resin R-2 had an acid value of 15 mg KOH/g.

<Production of Toner>

Hereinafter, production of toners TA-1 to TA-5 and TB-1 to TB-7 will be described. In the following description, a core containing no metal stearates will be referred to as "first core" and a core containing a metal stearate will be referred to as "second core". Further, a toner mother particle having the first core is referred to as "first toner mother particle" and a toner mother particle having the second core is referred to as "second toner mother particle". Further, toner particles including the first toner mother particles are referred to as "first particles" and toner particles including the second toner mother particles are referred to as "second particles".

[Production of Toner TA-1]

(First Core Preparing Process)

An FM mixer ("FM-2013" manufactured by Nippon Coke & Engineering Co., Ltd.) was charged with 100 parts by mass of the amorphous polyester resin R-1, 12 parts by mass of the composite resin R-2, 7 parts by mass of a release agent ("NISSAN ELECTOL (registered trademark) WEP-8" manufactured by NOF Corporation, ingredient: ester wax), and 9 parts by mass of a colorant ("MA100" manufactured by Mitsubishi Chemical Corporation, ingredient: carbon black) and the charged materials were mixed using the FM mixer at a rotation speed of 1200 rpm for three minutes.

Subsequently, the obtained mixture was melt-kneaded using a twin-screw extruder ("PCM-30" manufactured by Ikegai Corp.) under such conditions that the material supply rate was 100 g/min, the axial rotation speed was 150 rpm, and the cylinder temperature was 100° C. Then, the obtained melt-kneaded product was cooled. Subsequently, the cooled melt-kneaded product was coarsely pulverized with a set particle size of 2 mm using a pulverizer ("Rotoplex (registered trademark)" manufactured by Hosokawa Micron Corporation). Subsequently, the obtained coarsely pulverized product was finely pulverized using a pulverizer ("Turbo Mill RS type" manufactured by Freund-Turbo Corporation). Subsequently, the obtained finely pulverized product was classified using a classifier ("Elbow Jet EJ-LABO" manufactured by Nittetsu Mining Co., Ltd.). As a result, first cores having a volume median diameter ($D_{50}$) of 6.7 μm were obtained.

(Second Core Preparing Process)

Following the first core preparing process described above except that 300 parts by mass of zinc stearate particles ("NISSAN ELECTOL (registered trademark) MZ-2" manufactured by NOF Corporation) were further added to the FM mixer ("FM-20B" manufactured by Nippon Coke & Engineering Co., Ltd.), second cores having a volume median diameter ($D_{50}$) of 6.7 μm were obtained.

(Shell Layer Forming Process)

A three neck flask having a capacity of 1 L and equipped with a thermometer and a stirring blade was charged with 100 ml of ion-exchanged water, and the internal temperature of the flask was maintained at 30° C. using a water bath. Subsequently, 10 g of an oxazoline group-containing polymer aqueous solution ("EPOCROS (registered trademark) WS-700" manufactured by Nippon Shokubai Co., Ltd., solid content concentration: 25% by mass) was charged into the flask as a shell material, and the flask contents were stirred. Next, 95 g of the first cores obtained by the above-described process and 5 g of the second cores obtained by the above-described process were put into the flask, and the flask contents were stirred for one hour under such conditions that the flask internal temperature was 30° C. and the rotation speed was 200 rpm. Then, 100 mL of ion-exchanged water was added to the flask and 4 mL of an aqueous ammonia solution (concentration: 1% by mass) was further added. Then, while the flask contents were stirred at a rotation speed of 150 rpm, the internal temperature of the flask was raised to 60° C. at a temperature raising rate of 0.5° C./min. Next, the flask contents were stirred for one hour under such conditions that the flask internal temperature was 60° C. and the rotation speed was 100 rpm. While the internal temperature of the flask was maintained at 60° C., the first shell layer covering the surface of the first core was formed and the first toner mother particles were obtained. While the internal temperature of the flask was maintained at 60° C. the second shell layer covering the surface of the second core was formed and the second toner mother particles were obtained. After the completion of stirring, an aqueous ammonia solution (concentration: 1% by mass) was added to the flask to adjust the pH of the flask contents to 7, and the flask contents were cooled to a temperature of 25° C. Thus, a dispersion containing the first toner mother particles and the second toner mother particles was obtained. Each of the first shell layer and the second shell layer was formed of a specific vinyl resin that only contains, as repeating units, a repeating unit derived from methyl methacrylate, a repeating unit derived from butyl acrylate, the repeating unit (1-1), and the repeating unit (1-2).

(Washing Process)

Next, the obtained dispersion was subjected to filtration (solid-liquid separation) using a Buchner funnel to obtain a wet cake of the first toner mother particles and the second toner mother particles. Next, the obtained wet cake of the first toner mother particles and the second toner mother particles was redispersed in ion-exchanged water, and then filtered using a Buchner funnel. Further, redispersion and filtration were repeated five times to wash the first toner mother particles and the second toner mother particles.

(Drying Process)

Next, the washed first toner mother particles and second toner mother particles were dispersed in an aqueous ethanol solution having a concentration of 50% by mass. Thus, a slurry containing the first toner mother particles and the second toner mother particles was obtained. Subsequently, the first toner mother particles and the second toner mother particles in the slurry were dried using a continuous surface-modifying apparatus ("COATMIZER (registered trademark)" manufactured by Freund Corporation) under such conditions that the hot air temperature was 45° C. and the blower flow rate was 2 $m^3$/min. As a result, powder of the first toner mother particles and the second toner mother particles was obtained.

(External Addition Process)

An FM mixer ("FM-10B" manufactured by Nippon Coke & Engineering Co., Ltd.) was charged with the entire amount of the obtained first toner mother particles, the entire amount of the obtained second toner mother particles, and silica particles ("AEROSIL (registered trademark) REA90" manufactured by Nippon Aerosil Co., Ltd., silica particles to which positive chargeability is imparted by a surface treatment agent). At this time, the input amount of the silica particles was 3.0 parts by mass per 100 parts by mass in total of the first toner mother particles and the second toner mother particles. Subsequently, using the FM mixer, the charged materials were mixed for five minutes under such conditions that the rotation speed was 3000 rpm and the jacket temperature was 20° C. Thus, the entire amount of the external additive (powder of silica particles) was adhered to the surfaces of the first toner mother particles and the surfaces of the second toner mother particles.

Subsequently, the obtained powder was sieved using a 200-mesh sieve (mesh size: 75 μm). As a result, toner TA-1 (powder of the first particles and the second particles), which was a positively chargeable toner, was obtained. The composition ratio of the ingredients constituting the toner did not change before and after sieving.

[Production of Toner TA-2]

A positively chargeable toner TA-2 was obtained by following the method for producing the toner TA-1 except that the amount of the first cores charged into the flask was 75 g and the amount of the second cores charged into the flask was 25 g in the shell layer forming process.

[Production of Toner TA-3]

A positively chargeable toner TA-3 was obtained by following the method for producing the toner TA-1 except that the amount of the zinc stearate particles charged into the FM mixer was changed to 156 parts by mass in the second core preparing process.

[Production of Toner TA-4]

A positively chargeable toner TA-4 was obtained by following the method for producing the toner TA-1 except that the amount of the zinc stearate particles charged into the FM mixer was changed to 4139 parts by mass in the second core preparing process, and the amount of the first cores charged into the flask was 75 g and the amount of the second cores charged into the flask was 25 g in the shell layer forming process.

[Production of Toner TA-5]

A positively chargeable toner TA-5 was obtained by following the method for producing the toner TA-1 except that 300 parts by mass of calcium stearate particles (manufactured by Sakai Chemical Industry Co., Ltd.) were used instead of 300 parts by mass of zinc stearate particles in the second core preparing process.

[Production of Toner TB-1]

A positively chargeable toner TB-1 was obtained by following the method for producing the toner TA-1 except that the second cores were not charged into the flask in the shell layer forming process. In the external addition process for the production of the toner TB-1, only the first toner mother particles were used as the toner mother particles.

[Production of Toner TB-2]

A positively chargeable toner TB-2 was obtained by following the method for producing the toner TA-1 except that the second cores were not charged into the flask in the shell layer forming process and 1.0 parts by mass of zinc stearate particles ("NISSAN ELECTOL (registered trademark) MZ-2" manufactured by NOF Corporation) were further charged in the external addition process. In the external addition process for the production of the toner TB-2, only the first toner mother particles were used as the toner mother particles. The above amount (1.0 parts by mass) of the zinc stearate particles charged in the external addition process is the amount per 100 parts by mass of the first toner mother particles.

[Production of Toner TB-3]

A positively chargeable toner TB-3 was obtained by following the method for producing the toner TA-1 except that the second cores were not charged into the flask in the shell layer forming process and 0.5 parts by mass of zinc stearate particles ("NISSAN ELECTOL (registered trademark) MZ-2" manufactured by NOF Corporation) were further charged in the external addition process. In the external addition process for the production of the toner TB-3, only the first toner mother particles were used as the toner mother particles. The above amount (0.5 parts by mass) of the zinc stearate particles charged in the external addition process is the amount per 100 parts by mass of the first toner mother particles.

[Production of Toner TB-4]

A positively chargeable toner TB-4 was obtained by following the method for producing the toner TA-1 except that the amount of the first cores charged into the flask was 97 g and the amount of the second cores charged into the flask was 3 g in the shell layer forming process.

[Production of Toner TB-5]

A positively chargeable toner TB-5 was obtained by following the method for producing the toner TA-1 except that the amount of the first cores charged into the flask was 70 g and the amount of the second cores charged into the flask was 30 g in the shell layer forming process.

[Production of Toner TB-6]

A positively chargeable toner TB-6 was obtained by following the method for producing the toner TA-1 except that the amount of the zinc stearate particles charged into the FM mixer was changed to 105 parts by mass in the second core preparing process, and the amount of the first cores charged into the flask was 75 g and the amount of the second cores charged into the flask was 25 g in the shell layer forming process.

[Production of Toner TB-7]

A positively chargeable toner TB-7 was obtained by following the method for producing the toner TA-1 except that the second cores were not charged into the flask in the shell layer forming process and the powder of the second toner mother particles was replaced by an equal mass of powder of the second cores (that is to say, powder of cores obtained by the same preparation method as the second cores used for the production of the toner TA-1) in the external addition process.

<Measurement of Second Particle Number Ratio>

The toner to be measured (any of the toners TA-1 to TA-5 and TB-4 to TB-7) was sufficiently dispersed in a photocurable epoxy resin ("ARONIX (registered trademark) LCR D-800" manufactured by Toagosei Co., Ltd.), and then the obtained dispersion was cured for two days under ultraviolet irradiation in an atmosphere at a temperature of 40° C. After curing, the resulting cured product was cut using a microtome equipped with a diamond knife to prepare a thin piece. The obtained thin piece was exposed to a vapor of an aqueous ruthenium tetroxide solution (concentration: 0.5% by mass) for five minutes on a copper mesh to stain the thin piece with ruthenium. Subsequently, an image of a cross section of the stained thin piece sample was captured using a transmission electron microscope (TEM) ("H-7100FA" manufactured by Hitachi High-Technologies Corporation).

Next, 500 particles were randomly selected in the captured cross-sectional image. Next, particles each having the second core (second particles) were identified among the selected 500 particles using image analysis software ("WinROOF" manufactured by Mitani Corporation), and the number $N_2$ of such particles was counted. It should be noted that metal stearates are less likely to be stained than resins. Therefore, a difference in image brightness is observed between a region occupied by a metal stearate and a region occupied by a substance other than the metal stearate depending on the effects of staining, so that it is possible to distinguish the first particles and the second particles from each other in the cross-sectional image. Then, the second particle number ratio (unit: %) was calculated by a calculation formula represented by the following formula (2). In the following formula (2), $N_t$ is 500.

$$\text{Second particle number ratio} = 100 \times N_2 / N_t \quad (2)$$

<Measurement of Thickness of First Shell Layer and Thickness of Second Shell Layer>

The toner to be measured (any of the toners TA-1 to TA-5 and TB-1 to TB-7) was sufficiently dispersed in a photocurable epoxy resin ("ARONIX (registered trademark) LCR D-800" manufactured by Toagosei Co., Ltd.), and then the obtained dispersion was cured for two days under ultraviolet irradiation in an atmosphere at a temperature of 40° C. After curing, the resulting cured product was cut using a microtome equipped with a diamond knife to prepare a thin piece. The obtained thin piece was exposed to a vapor of an aqueous ruthenium tetroxide solution (concentration: 0.5% by mass) for five minutes on a copper mesh to stain the thin piece with ruthenium. Subsequently, an image of a cross section of the stained thin piece sample was captured at a magnification of 100,000 using a transmission electron microscope (TEM) ("H-7100FA" manufactured by Hitachi High-Technologies Corporation). Then, the thickness of the first shell layer and the thickness of the second shell layer were measured by analyzing the TEM image using image analysis software ("WinROOF" manufactured by Mitani Corporation).

The measurement procedure was as follows: Initially, ten first particles included in the measurement target (toner) were randomly selected in the captured cross-sectional image. Then, for each of the selected ten first particles, the thickness of the first shell layer was measured, and the evaluation value (thickness of the first shell layer) of the toner to be measured was obtained. More specifically, with respect to each of the first particles (cross sections thereof, two straight lines perpendicular to each other substantially at the center of the relevant cross section were drawn, and the thickness of the first shell layer was measured at each of four locations where the two straight lines intersected the first shell layer. The arithmetic average of the thicknesses measured at the four locations was defined as the thickness of the first shell layer of the relevant first particle. For each of the selected ten first particles, the thickness of the first shell layer was measured, and the number average of the measured thicknesses was defined as the evaluation value (thickness of the first shell layer) of the toner to be measured.

In the captured cross-sectional image, ten second particles included in the measurement target (toner) were randomly selected. Then, for each of the selected ten second particles, the thickness of the second shell layer was measured, and the evaluation value (thickness of the second shell layer) of the toner to be measured was obtained. More specifically, with respect to each of the second particles (cross sections thereof), two straight lines perpendicular to each other substantially at the center of the relevant cross section were drawn, and the thickness of the second shell layer was measured at each of four locations where the two straight lines intersected the second shell layer. The arithmetic average of the thicknesses measured at the four locations was defined as the thickness of the second shell layer of the relevant second particle. For each of the selected ten second particles, the thickness of the second shell layer was measured, and the number average of the measured thicknesses was defined as the evaluation value (thickness of the second shell layer) of the toner to be measured.

From the cross-sectional images used in the measurement of the thickness of the first shell layer and the thickness of the second shell layer, it was confirmed that the first shell coverage and the second shell coverage of each of the toners TA-1 to TA-5 were both 90% or more but 100% or less.

For each of the toners TA-1 to TA-5 and TB-1 to TB-7, the type of the metal stearate used, the metal stearate content, the second particle number ratio, the thickness of the first shell layer, and the thickness of the second shell layer are shown in Table 1. In Table 1, "ZnSt" represents zinc stearate. In Table 1, "CaSt" represents calcium stearate. In Table 1, the metal stearate content refers to the content of the metal stearate in the second core with respect to the mass of the second core as a whole (the metal stearate content as described above). In Table 1, the symbol "-" means that the second particles were not used.

TABLE 1

| | Metal stearate | | | | |
|---|---|---|---|---|---|
| Toner | Type | Metal stearate contnt [% by mass] | Second particle number ratio [%] | Thickness of first shell layer [nm] | Thickness of second shell layer [nm] |
| TA-1 | ZnSt | 70 | 5 | 30 | 10 |
| TA-2 | ZnSt | 70 | 25 | 30 | 10 |
| TA-3 | ZnSt | 55 | 5 | 30 | 15 |
| TA-4 | ZnSt | 97 | 25 | 30 | 3 |
| TA-5 | CaSt | 70 | 5 | 30 | 10 |
| TB-1 | — | — | — | 30 | — |
| TB-2 | — | — | — | 30 | — |
| TB-3 | — | — | — | 30 | — |
| TB-4 | ZnSt | 70 | 3 | 30 | 10 |
| TB-5 | ZnSt | 70 | 30 | 30 | 10 |
| TB-6 | ZnSt | 45 | 25 | 30 | 2 |
| TB-7 | ZnSt | 70 | 5 | 30 | 0 |

<Evaluation Method>

[Charge Amount Distribution]

A polyethylene container having a capacity of 20 mL was charged with 5 g of the toner to be evaluated (any of the toners TA-1 to TA-5 and TB-1 to TB-7) and 10 g of a developer carrier (carrier for "TASKalfa 5550ci" manufactured by KYOCERA Document Solutions Inc.). Next, the sample (toner and carrier) in the container was stirred at a rotation speed of 100 rpm for ten minutes.

Next, the toner in the sample was set on a charge amount and particle size distribution measuring machine ("E-Spart Analyzer (registered trademark)" manufactured by Hosokawa Micron Corporation), and the charge amount and the charge amount distribution of the toner were measured. Regarding the measured charge amount distribution, the horizontal axis represented the "Q/d (charge amount/particle size)" (unit: fC/μm), and the vertical axis represented the frequency (number). The E-Spart Analyzer is a device that detects the movement of particles under the influence of an electric field (electric field of constant intensity) and an acoustic field (air vibration of constant frequency) by a laser Doppler method and measures the charge amount and the particle size of each particle simultaneously.

From the obtained charge amount distribution of the toner, the width of the frequency, which is one fourth of the frequency of the mode, (hereinafter referred to as "¼ value width") was determined. A ¼ value width of the charge amount distribution of less than 0.9 fC/μm was evaluated as good, and a ¼ value width of the charge amount distribution of 0.9 fC/μm or more was evaluated as bad. A small ¼ value width of the charge amount distribution indicates that the charge amount distribution is sharp, and a large ¼ value width of the charge amount distribution indicates that the charge amount distribution is broad.

[Preparation of Two Component Developer]

Using a ball mill, 100 parts by mass of a carrier for "TASKalfa 5550ci" manufactured by KYOCERA Document Solutions Inc. and 10 parts by mass of toner (evaluation target: any of the toners TA-1 to TA-5 and TB-1 to TB-7) were mixed for 30 minutes to prepare a two component developer for evaluation.

[Image Deletion]

A color multifunction peripheral ("TASKalfa 5550ci" manufactured by KYOCERA Document Solutions Inc.) was used as an evaluation apparatus. The two component developer including the evaluation target (the two component developer having been prepared by the method described above) was put into a black developing device of the evaluation apparatus, and the toner (evaluation target: any of the toners TA-1 to TA-5 and TB-1 to TB-7) was put into a black toner container of the evaluation apparatus. Next, the evaluation apparatus was used to continuously print an image having a printing rate of 10% on 10,000 printing sheets (A4 size sheets of plain paper) in an environment at a temperature of 32.5° C. and a relative humidity of 20%. Next, the evaluation apparatus after printing was left to stand for 24 hours in an environment at a temperature of 32.5° C. and a relative humidity of 80%. Next, the evaluation apparatus having been left to stand for 24 hours was used to output a halftone image (image density: 50%) on the entire surface of one printing sheet (A4 size sheet of plain paper) in an environment at a temperature of 32.5° C. and a relative humidity of 80%. Next, the output image was visually observed, and evaluated according to the following criteria. When the evaluation result was A, it was determined that the occurrence of image deletion was successfully suppressed. On the other hand, when the evaluation result was B, it was determined that the occurrence of image deletion was unsuccessfully suppressed.

(Criteria)

A: The halftone image was output without blurring, and image deletion was not recognized.

B: The halftone image was output in a blurred state due to image deletion.

[Fogging Density]

A color multifunction peripheral ("TASKalfa 5550ci" manufactured by KYOCERA Document Solutions Inc.) was used as an evaluation apparatus. The two component developer including the evaluation target (the two component developer having been prepared by the method described above) was put into a black developing device of the evaluation apparatus, and the toner (evaluation target: any of the toners TA-1 to TA-5 and TB-1 to TB-7) was put into a black toner container of the evaluation apparatus. Next, the evaluation apparatus was used to continuously print an image having a printing rate of 10% on 10,000 printing sheets (A4 size sheets of plain paper) in an environment at a temperature of 23° C. and a relative humidity of 50%. Next, the evaluation apparatus was used to print a solid image having a size of 20 mm×30 mm on one printing sheet (A4 size sheet of plain paper) in an environment at a temperature of 23° C. and a relative humidity of 50%.

Next, the reflection density of a blank portion of the printed sheet was measured by a reflection densitometer ("SpectroEye (registered trademark)" manufactured by X-Rite Inc.). Then, the fogging density (FD) was calculated based on the following formula. When the fogging density was 0.010 or less, it was determined that the occurrence of fogging was successfully suppressed, and when the fogging density exceeded 0.010, it was determined that the occurrence of fogging was unsuccessfully suppressed.

Fogging density=(reflection density of blank portion)−(reflection density of unprinted sheet)

<Evaluation Results>

For each of the toners TA-1 to TA-5 and TB-1 to TB-7, the ¼ value width, the evaluation result on the image deletion, and the fogging density are shown in Table 2.

TABLE 2

| | Toner | ¼ Value width [fC/μm] | Evaluation result on image deletion | Fogging density |
|---|---|---|---|---|
| Example 1 | TA-1 | 0.5 | A | 0.006 |
| Example 2 | TA-2 | 0.8 | A | 0.007 |
| Example 3 | TA-3 | 0.4 | A | 0.004 |
| Example 4 | TA-4 | 0.8 | A | 0.009 |
| Example 5 | TA-5 | 0.6 | A | 0.006 |
| Comparative Example 1 | TB-1 | 0.3 | B | 0.004 |
| Comparative Example 2 | TB-2 | 1.0 | A | 0.020 |
| Comparative Example 3 | TB-3 | 0.8 | B | 0.008 |
| Comparative Example 4 | TB-4 | 0.5 | B | 0.006 |
| Comparative Example 5 | TB-5 | 1.1 | A | 0.020 |
| Comparative Example 6 | TB-6 | 0.8 | B | 0.008 |
| Comparative Example 7 | TB-7 | 1.4 | A | 0.040 |

The toners TA-1 to TA-5 each included, as toner particles, the first particles, each of which included the first core containing no metal stearates and the first shell layer, and the second particles, each of which included the second, core containing a metal stearate and, the second shell layer. In the toners TA-1 to TA-5, the first shell layer and the second shell layer were formed of resins of the same type (resins each deemed to be the specific vinyl resin), respectively. As shown in Table 1, in the toners TA-1 to TA-5, the metal stearate content was 50% by mass or more. In the toners TA-1 to TA-5, the second particle number ratio was 5% or more but 25% or less.

As shown in Table 2, for the toners TA-1 to TA-5, the evaluation result on the image deletion was A. Therefore, the toners TA-1 to TA-5 were able to suppress the occurrence of image deletion.

As shown in Table 2, for the toners TA-1 to TA-5, the fogging density was 0.010 or less. Therefore, the toners TA-1 to TA-5 were able to suppress the occurrence of fogging. For the toners TA-1 to TA-5, the ¼ value width was less than 0.9 fC/μm (that is to say, the charge amount distribution was relatively sharp), so that it is considered that the occurrence of fogging was successfully suppressed As shown in Table 1, none of the toners TB-1 to TB-3 included the second particles containing a metal stearate. In the toner TB-4, the second particle number ratio was less than 5%. In the toner TB-5, the second particle number ratio exceeded 25%. In the toner TB-6, the metal stearate content was less than 50% by mass. The toner TB-7 included toner particles containing a metal stearate, but no shell layers were formed on the toner particles.

As shown in Table 2, for the toners TB-1. TB-3, TB-4, and TB-6, the evaluation result on the image deletion was B. Therefore, none of the toners TB-1. TB-3. TB-4, and TB-6 could suppress the occurrence of image deletion. For the toners TB-2. TB-5, and TB-7, the fogging density exceeded 0.010. Therefore, none of the toners TB-2, TB-5, and TB-7 could suppress the occurrence of fogging.

From the above results, it was found that, according to the present disclosure, the occurrence of image deletion and the occurrence of fogging are suppressed.

What is claimed is:

1. Toner comprising first particles and second particles at a predetermined number ratio, wherein the first particles each comprise a first toner mother particle that includes a first core and a first shell layer covering a surface of the first core, the first core containing a binder resin and being free from metal stearates, the second particles each comprise a second toner mother particle that includes a second core and a second shell layer covering a surface of the second core, the second core containing a metal stearate, the first shell layer and the second shell layer are formed of resins of a same type, respectively, a content of the metal stearate in the second core is 50% by mass or more with respect to mass of the second core as a whole, and the predetermined number ratio of the second particles is 5% or more but 25% or less of a total number of the first particles and the second particles.

2. The toner according to claim 1, wherein an amount of the second particles is 5 parts by mass or more but 33 parts by mass or less per 100 parts by mass of the first particles.

3. The toner according to claim 1, wherein a thickness of the second shell layer is 3 nm or more but 30 nm or less.

4. The toner according to claim 1, wherein the metal stearate in the second core is zinc stearate or calcium stearate.

5. The toner according to claim 1, wherein the first core contains a polyester resin as the first binder resin, the second core further contains a polyester resin as a second binder resin, and the first shell layer and the second shell layer are each formed of a polymerization product of a monomer including at least a compound represented by formula (1) below:

[Chemical Formula 1]

(1)

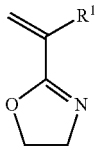

[where R1 represents an alkyl group that has 1 to 6 carbon atoms and may be substituted with a phenyl group or represents a hydrogen atom].

6. The toner according to claim 5, wherein the first shell layer and the second shell layer are each formed of a resin including at least a repeating unit represented by formula (1-1) below:

[Chemical Formula 2]

(1-1)

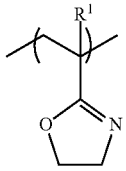

[where R1 represents an alkyl group that has 1 to 6 carbon atoms and may be substituted with a phenyl group or represents a hydrogen atom] and a repeating unit represented by formula (1-2) below:

[Chemical Formula 3]

(1-2)

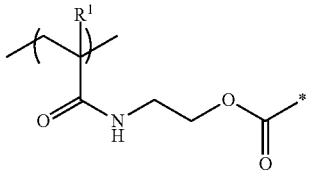

[where R1 represents an alkyl group that has 1 to 6 carbon atoms and may be substituted with a phenyl group or represents a hydrogen atom; and * represents a site to be bonded to an atom in the first core or an atom in the second core].

* * * * *